US011081127B2

(12) United States Patent
Hur et al.

(10) Patent No.: US 11,081,127 B2
(45) Date of Patent: Aug. 3, 2021

(54) ELECTRONIC DEVICE AND CONTROL METHOD THEREFOR

(71) Applicant: SAMSUNG ELECTRONICS CO., LTD., Suwon-si (KR)

(72) Inventors: Jaemyung Hur, Suwon-si (KR); Kunsok Kang, Suwon-si (KR); Hyunkyu Yun, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/961,420

(22) PCT Filed: Dec. 21, 2018

(86) PCT No.: PCT/KR2018/016469
§ 371 (c)(1),
(2) Date: Jul. 10, 2020

(87) PCT Pub. No.: WO2019/143036
PCT Pub. Date: Jul. 25, 2019

(65) Prior Publication Data

US 2020/0381007 A1 Dec. 3, 2020

(30) Foreign Application Priority Data

Jan. 18, 2018 (KR) ..... 10-2018-0006718

(51) Int. Cl.
*G10L 25/51* (2013.01)
*G10L 25/21* (2013.01)
(Continued)

(52) U.S. Cl.
CPC ..... *G10L 25/51* (2013.01); *G10L 25/21* (2013.01); *H04R 1/403* (2013.01); *H04R 3/12* (2013.01); *H04R 29/002* (2013.01)

(58) Field of Classification Search
None
See application file for complete search history.

(56) References Cited

U.S. PATENT DOCUMENTS 9,763,008 B2 9/2017 Johnson et al.
2002/0067835 A1* 6/2002 Vatter ..... G01H 7/00 381/58
(Continued)

FOREIGN PATENT DOCUMENTS

FR 2 895 542 5/2008
JP 2011-158794 8/2011
(Continued)

OTHER PUBLICATIONS

International Search Report for PCT/KR2018/016469 dated Apr. 4, 2019, 5 pages with English Translation.
(Continued)

*Primary Examiner* — Paul W Huber
(74) *Attorney, Agent, or Firm* — Nixon & Vanderhye, P.C.

(57) ABSTRACT

An electronic device is disclosed. The electronic device comprises a communication unit, a speaker, and a processor for: outputting a test sound through the speaker when a preset signal is received from an external terminal device through the communication unit; acquiring, on the basis of sound data, reverberation time information for each frequency of the test sound and size information on a space in which the electronic device is positioned when sound data acquired by recording a test sound in a terminal device is received through the communication unit; acquiring, on the basis of the reverberation time information for each frequency and the size information on a space, a sound absorp-
(Continued)

tion rate of an object arranged in the space; and identifying information on the object on the basis of the sound absorption rate.

15 Claims, 10 Drawing Sheets

(51) Int. Cl.

| | |
|---|---|
| ***H04R 1/40*** | (2006.01) |
| ***H04R 3/12*** | (2006.01) |
| ***H04R 29/00*** | (2006.01) |

(56) References Cited

U.S. PATENT DOCUMENTS

| | | | | |
|---|---|---|---|---|
| 2009/0129604 | A1 | 5/2009 | Enamito et al. | |
| 2010/0104114 | A1 | 4/2010 | Chapman | |
| 2010/0296658 | A1* | 11/2010 | Ohashi | H04S 7/305 381/57 |
| 2013/0321566 | A1 | 12/2013 | Simonnet | |
| 2015/0067787 | A1 | 3/2015 | Stanasolovich et al. | |
| 2015/0078596 | A1* | 3/2015 | Sprogis | H04S 7/301 381/303 |
| 2016/0061597 | A1 | 3/2016 | De Bruijn | |
| 2017/0223478 | A1 | 8/2017 | Jot et al. | |
| 2019/0394602 | A1* | 12/2019 | Moore | H04R 1/403 |

FOREIGN PATENT DOCUMENTS

| | | |
|---|---|---|
| JP | 5403896 | 1/2014 |
| KR | 10-2015-0107699 | 9/2015 |
| KR | 10-1721406 | 3/2017 |
| KR | 10-1787224 | 10/2017 |
| WO | 2014/091027 | 6/2014 |

OTHER PUBLICATIONS

Written Opinion of the ISA for PCT/KR2018/016469 dated Apr. 4, 2019, 9 pages with English Translation.

* cited by examiner

Sound Absorption Coefficients

| | | | | | | |
|---|---|---|---|---|---|---|
| Rockfon Sonar | 0.45 | 0.85 | 1.00 | 1.00 | 1.00 | 1.00 |
| Perforated Gypsum | 0.55 | 0.70 | 0.75 | 0.65 | 0.60 | 0.55 |
| Wetfelt Tile | 0.40 | 0.45 | 0.55 | 0.60 | 0.50 | 0.45 |
| Carpet | 0.01 | 0.02 | 0.05 | 0.15 | 0.30 | 0.40 |
| Stone/Linoleum | 0.02 | 0.02 | 0.05 | 0.05 | 0.05 | 0.07 |
| Unperforated Gypsum | 0.10 | 0.10 | 0.05 | 0.05 | 0.00 | 0.05 |

ELECTRONIC DEVICE AND CONTROL METHOD THEREFOR

This application is the U.S. national phase of International Application No. PCT/KR2018/016469 filed Dec. 21, 2018 which designated the U.S. and claims priority to KR Patent Application No. 10-2018-0006718 filed Jan. 18, 2018, the entire contents of each of which are hereby incorporated by reference.

TECHNICAL FIELD

This disclosure relates to an electronic device and a control method therefor, and more particularly relates to an electronic device which outputs a test sound and a control method therefor.

BACKGROUND ART

Various types of electronic products have been developed and distributed along the development of electronic technologies and functions executed using electronic devices have become diverse.

In particular, various methods for obtaining information on a specific space using electronic devices have been actively researched. For example, various electronic devices which obtain information on a stage space for a play or a space for orchestra performance and provide more optimized sounds to an audience and methods therefor have been developed.

However, the cost of a measurement device which obtains information on the space was high and the measurement device was only suitable for a large space such as a stage rather than a small space such as a house.

Accordingly, there was a need for development of an electronic device which obtains information on a space even in a house and provides contents, services, and the like optimized according to characteristics of the space, a measurement device, and a method therefor.

DISCLOSURE

Technical Problem

The disclosure is made in view of the needs described above and an object of the disclosure is to provide an electronic device which obtains information on a space in which the electronic device is positioned and a control method therefor.

Technical Solution

According to an embodiment of the disclosure for achieving the object described above, there is provided an electronic device including a communicator, a speaker, and a processor configured to, based on a predetermined signal being received from an external terminal device via the communicator, output a test sound via the speaker, based on sound data obtained by recording the test sound being received from the terminal device via the communicator, obtain reverberation time information for each frequency of the test sound and size information of a space in which the electronic device is positioned, based on the sound data, obtain a sound absorption coefficient of an object arranged in the space based on the reverberation time information for each frequency and the size information of the space, and identify information of the object based on the sound absorption coefficient, in which a size of the space is obtained based on an energy intensity for each frequency until a volume of the test sound reaches a predetermined threshold value and an energy intensity for each frequency for a predetermined period of time from an output point of the test sound.

The test sound may be a sound having a plurality of different frequencies in a range of audio frequency.

The device may further include an output unit, and the processor may be configured to control the output unit to output an audio content, and based on a sound absorption coefficient corresponding to at least one frequency among sound absorption coefficients of an object positioned in the space being equal to or higher than a predetermined value, compensate an audio signal corresponding to the frequency in the audio content and output the audio signal.

The processor may be configured to obtain size information of the space based on a ratio of the energy intensity for each frequency for a predetermined period of time from the output point of the test sound, to the energy intensity for each frequency until a volume of the test sound reaches a predetermined threshold value.

The device may further include a storage storing information of a sound absorption coefficient for each object and space size information for each ratio, and the processor may be configured to obtain a sound absorption coefficient of an object arranged in the space and size information of the space based on the information stored in the storage.

The device may further include a storage storing size information of the space according to the reverberation time for each frequency and the ratio, and the processor may be configured to obtain the size information of the space based on the information stored in the storage.

The reverberation time may be a period of time taken for a decrease in sound pressure level of the test sound recorded at an output point of the test sound by 60 dB.

The device may be positioned in a first space including a first object, and the processor may be configured to, based on at least one of size information of a second space in which another electronic device is positioned and information of a second object included in the second space being received from the other electronic device, identify the electronic device as a communal electronic device or a personal electronic device based on the received information and information of a size of the first space and the first object.

The processor may be configured to, based on the electronic device being identified as the communal electronic device, limit an access to at least one of a setting menu of the electronic device, a content payment menu, and a content view history menu.

The speaker may include first and second speakers arranged to be spaced apart from each other, and the processor may be configured to output a first test sound via the first speaker, and output a second test sound via the second speaker after a predetermined period of time, and based on first and second sound data pieces corresponding to the first and second test sounds, respectively, being received from the terminal device, obtain reverberation time information for each frequency of the first and second test sounds and size information of a space in which the electronic device is positioned, based on the first and second sound data.

According to another embodiment of the disclosure, there is provided a method for controlling an electronic device, the method including, based on a predetermined signal being received from an external terminal device, outputting a test sound, based on sound data obtained by recording the test sound being received from the terminal device, obtaining reverberation time information for each frequency of the test sound and size information of a space in which the electronic device is positioned, based on the sound data, obtaining a sound absorption coefficient of an object arranged in the space based on the reverberation time information for each frequency and the size information of the space, and identifying information of the object based on the obtained sound absorption coefficient, in which a size of the space is obtained based on an energy intensity for each frequency until a volume of the test sound reaches a predetermined threshold value and an energy intensity for each frequency for a predetermined period of time from an output point of the test sound.

The test sound may be a sound having a plurality of different frequencies in a range of audio frequency.

The method may further include outputting an audio content, and the outputting may include, based on a sound absorption coefficient corresponding to at least one frequency among sound absorption coefficients of an object positioned in the space being equal to or higher than a predetermined value, compensating an audio signal corresponding to the frequency in the audio content and outputting the audio signal.

The obtaining size information of a space may include obtaining size information of the space based on a ratio of the energy intensity for each frequency for a predetermined period of time from the output point of the test sound, to the energy intensity for each frequency until a volume of the test sound reaches a predetermined threshold value.

The electronic device may store information of a sound absorption coefficient for each object and space size information for each ratio, the obtaining size information of a space may include obtaining size information of the space based on the space size information for each ratio, and the obtaining a sound absorption coefficient may include obtaining a sound absorption coefficient of an object arranged in the space based on the information of a sound absorption coefficient for each object.

The electronic device may store size information of the space according to the reverberation time for each frequency and the ratio, and the obtaining size information of a space may include obtaining the size information of the space based on the information.

The reverberation time may be a period of time taken for a decrease in sound pressure level of the test sound recorded at an output point of the test sound by 60 dB.

The electronic device may be positioned in a first space including a first object, and the method may further include receiving at least one of size information of a second space in which another electronic device is positioned and information of a second object included in the second space from the other electronic device, and identifying the electronic device as a communal electronic device or a personal electronic device based on the received information and information of a size of the first space and the first object.

The method may further include, based on the electronic device being identified as the communal electronic device, limiting an access to at least one of a setting menu of the electronic device, a content payment menu, and a content view history menu.

According to still another embodiment of the disclosure, there is provided a non-transitory computer-readable recording medium storing computer instructions to enable an electronic device to execute operations, when computer instructions are executed by a processor of the electronic device, in which the operations include, based on a predetermined signal being received from an external terminal device, outputting a test sound, based on sound data obtained by recording the test sound being received from the terminal device, obtaining reverberation time information for each frequency of the test sound and size information of a space in which the electronic device is positioned, based on the sound data, obtaining a sound absorption coefficient of an object arranged in the space based on the reverberation time information for each frequency and the size information of the space, and identifying information of the object based on the obtained sound absorption coefficient, and a size of the space is obtained based on an energy intensity for each frequency until a volume of the test sound reaches a predetermined threshold value and an energy intensity for each frequency for a predetermined period of time from an output point of the test sound.

Effect of Invention

According to the embodiments of the disclosure, the electronic device is advantageous in terms of obtaining information on a space in which the electronic device is positioned, by outputting a test sound.

BEST MODE

Figure 1:
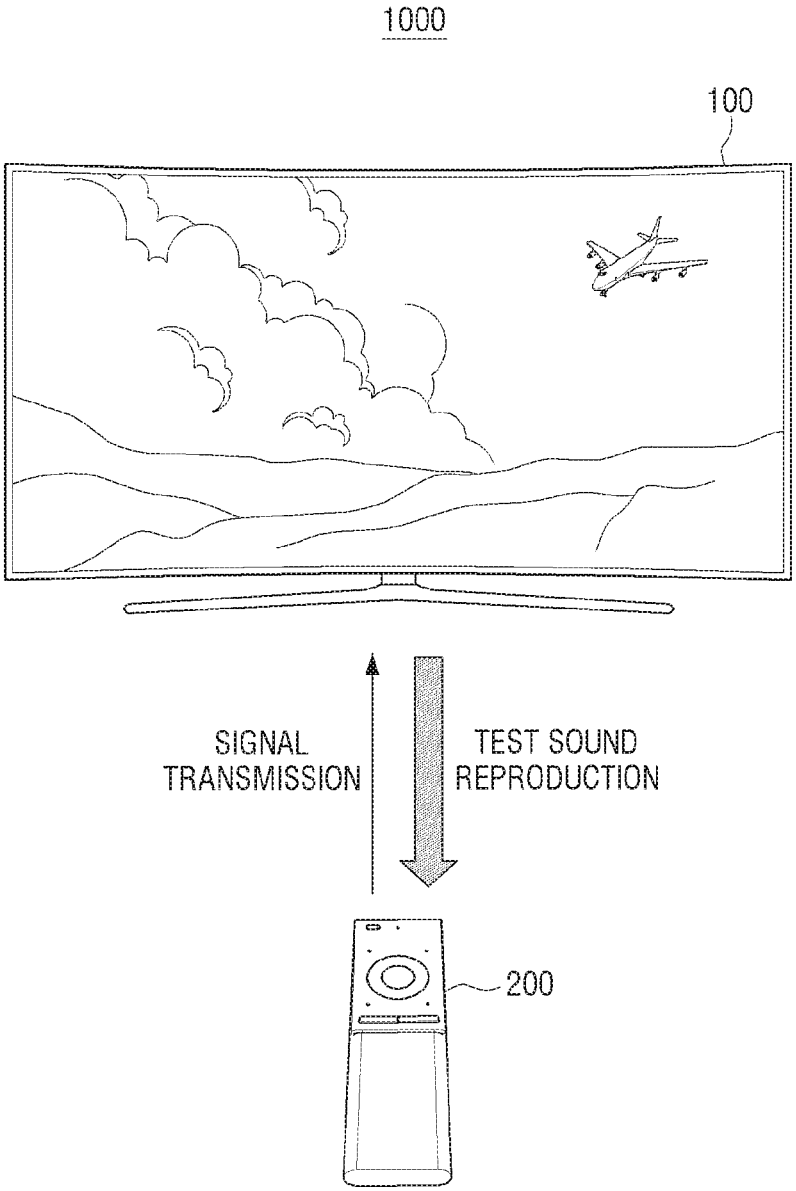
FIG. 1 is a view illustrating an electronic system according to an embodiment.

The disclosure will be described in detail after briefly explaining the terms used in the specification.

The terms used in embodiments of the disclosure have been selected as widely used general terms as possible in consideration of functions in the disclosure, but these may vary in accordance with the intention of those skilled in the art, the precedent, the emergence of new technologies and the like. In addition, in a certain case, there is also a term arbitrarily selected by the applicant, in which case the meaning will be described in detail in the description of the disclosure. Therefore, the terms used in the disclosure should be defined based on the meanings of the terms themselves and the contents throughout the disclosure, rather than the simple names of the terms.

The embodiments of the disclosure may be variously changed and include various embodiments, and specific embodiments will be shown in the drawings and described in detail in the description. However, it should be understood that this is not to limit the scope of the specific embodiments and all modifications, equivalents, and/or alternatives included in the disclosed spirit and technical scope are included. In describing the disclosure, a detailed description of the related art is omitted when it is determined that the detailed description may unnecessarily obscure a gist of the disclosure.

The terms "first," "second," or the like may be used for describing various elements but the elements may not be limited by the terms. The terms are used only to distinguish one element from another.

Unless otherwise defined specifically, a singular expression may encompass a plural expression. It is to be understood that the terms such as "comprise" or "consist of" are used herein to designate a presence of characteristic, number, step, operation, element, part, or a combination thereof, and not to preclude a presence or a possibility of adding one or more of other characteristics, numbers, steps, operations, elements, parts or a combination thereof.

A term such as "module" or a "unit" in the disclosure may perform at least one function or operation, and may be implemented as hardware, software, or a combination of hardware and software. Further, except for when each of a plurality of "modules", "units", and the like needs to be realized in an individual hardware, the components may be integrated in at least one module and be implemented in at least one processor (not shown).

Hereinafter, with reference to the accompanying drawings, embodiments of the disclosure will be described in detail so that those skilled in the art can easily make and use the embodiments in the technical field to which the disclosure belongs. But, the disclosure may be implemented in various different forms and is not limited to the embodiments described herein. In addition, in the drawings, the parts not relating to the description are omitted for clearly describing the disclosure, and the same reference numerals are used for the same parts throughout the specification.

FIG. 1 is a view illustrating an electronic system 1000 according to an embodiment of the disclosure.

Referring to FIG. 1, the electronic system 1000 includes an electronic device 100 and a terminal device 200.

The electronic device 100 according to an embodiment of the disclosure may be implemented as devices in various forms such as a user terminal device, a display device, a set-top box, a tablet personal computer (PC), a smartphone, an e-book reader, a desktop PC, a laptop PC, a workstation, a server, a personal digital assistant (PDA), a portable multimedia player (PMP), an MP3 player, and the like. But, this is merely an embodiment, and the electronic device 100 may be implemented as various types of devices capable of outputting a sound.

According to an embodiment, the electronic device 100 may execute communication with the terminal device 200. In particular, the electronic device 100 may receive signals, data, and the like transmitted by the terminal device 200 according to various types of communication systems such as IR, RF, and the like. For example, the terminal device 200 may be implemented as a remote controlling device for controlling the electronic device 100 and the electronic device 100 may receive a control signal transmitted by the terminal device 200. The electronic device 100 may transmit and receive data to and from the terminal device 200.

The electronic device 100 may output a test sound, when a predetermined signal is received from the external terminal device 200. The test sound may mean a predetermined sound source for identifying characteristics of a space in which the electronic device 100 is positioned. For example, the test sound may be a sound having an audio frequency at 16 hZ to 20 kHz. However, there is no limitation thereto, and the electronic device 100 may output a plurality of test sounds different from each other. For example, the electronic device 100 may sequentially output a first test sound in a low frequency band (e.g., 20 Hz to 160 Hz), a second test sound in a medium frequency band (e.g., 160 Hz to 1,280 Hz), and a third test sound in the high frequency band (1,280 Hz to 20 kHz).

According to an embodiment, the predetermined signal transmitted by the external terminal device 200 to the electronic device 100 may be a signal requesting for output of the test sound. However, this is merely an embodiment, and the electronic device 100 may output the test sound in various situations, for example, every time of a predetermined operation of the electronic device 100 or at an initial setting stage.

The terminal device 200 according to an embodiment of the disclosure may obtain sound data by recording the test sound output by the electronic device 100. Particularly, the terminal device 200 may transmit the sound data to the electronic device 100. The electronic device 100 may identify characteristics of a space in which the electronic device 100 is positioned by analyzing the received sound data. The characteristics of the space may mean objects arranged in the space, size information of the space, and the like. For example, the electronic device 100 may identify whether or not the furniture, carpet, and the like are arranged in the space in which the electronic device 100 is positioned, the size of the space, and the like.

Hereinabove, the operations of the electronic device 100 and the terminal device 200 included in the electronic system 1000 have been briefly described. Hereinafter, the operations of the electronic device 100 will be described in detail.

Figure 2:
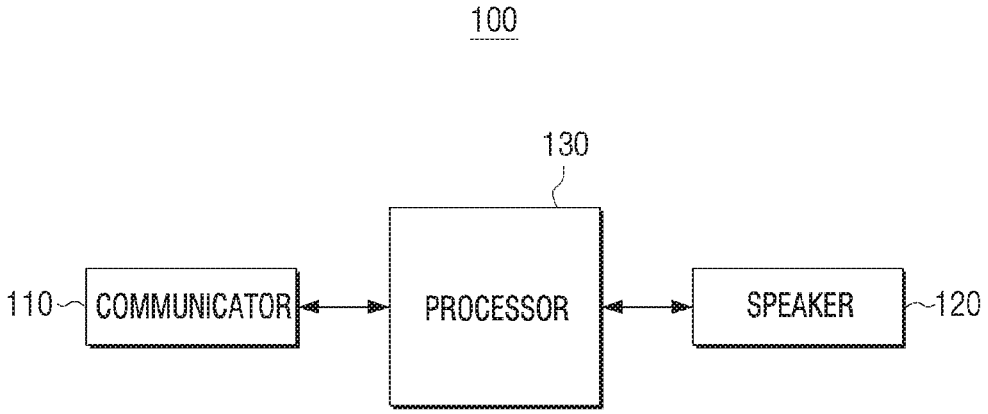
FIG. 2 is a block diagram illustrating a configuration of an electronic device according to an embodiment.

FIG. 2 is a block diagram illustrating a configuration of the electronic device 100 according to an embodiment of the disclosure.

Referring to FIG. 2, the electronic device 100 includes a communicator 110, a speaker 120, and a processor 130.

The communicator 110 is a component for executing communication with the external terminal device 200. In particular, the communicator 110 may receive signals, data, and the like transmitted from the external terminal device 200. The signals may mean various types of control signals for controlling the electronic device 100. For example, the electronic device 100 may receive a predetermined signal for requesting output of the test sound from the external terminal device 200 via the communicator 110. The control signals may be signals in various forms such as an infrared ray (IR) or a radio frequency (RF).

The communicator 110 according to an embodiment may receive the sound data obtained by recording the test sound from the external terminal device 200. The sound data may be data generated by recording the sound data output by the electronic device 100 through a microphone or the like included in the terminal device 200.

The speaker 120 is a component for outputting various sounds. Particularly, the speaker 120 may output the test sound. The speaker 120 according to an embodiment of the disclosure may include first and second speakers arranged to be spaced apart from each other.

The processor 130 controls general operations of the electronic device 100. The processor 130 may include one or more of a digital signal processor (DSP), a central processing unit (CPU), a controller, an application processor (AP), or a communication processor (CP), and an ARM processor or may be defined as the corresponding term. In addition, the processor 130 may be implemented as System on Chip (SoC) or large scale integration (LSI) including the processing algorithm or may be implemented in form of a Field Programmable gate array (FPGA).

In particular, when the sound data obtained by recording the test sound is received from the terminal device 200, the processor 130 may obtain reverberation time information for each frequency of the test sound and size information of the space in which the electronic device 100 is positioned, based on the sound data.

The test sound may be a sound having a plurality of frequencies. For example, the test sound may have a plurality of different frequencies in a range of the audio frequency (e.g., 16 Hz to 20 kHz). The test sound may be implemented as one sound source. However, this is merely an embodiment, and the test sound may be implemented as a plurality of sound sources such as a first test sound having a plurality of frequencies in a first range and a second test sound having a plurality of frequencies in a second range.

The reverberation time information for each frequency of the test sound according to an embodiment may mean information on the reverberation time for each of the plurality of frequencies of the test sound. The test sound output via the speaker of the electronic device 100 may be recorded by the terminal device 200. Some of the output test sounds may be directly transmitted to the terminal device 200 and the others thereof may be reflected by an object such as a wall and then transmitted thereto. Accordingly, the sound reflected may be recorded by the terminal device 200 with a time difference from the directly transmitted sound. Hereinafter, the directly transmitted sound and the sound reflected are collectively referred to as a direct sound and reflected sound (reflection-tone), respectively.

It is possible to assume a sense of space of the sound according to the time difference between the direct sound and the reflected sound and such a time difference is called reverb. In general, the reverberation means that the time difference between the direct sound and the reflected sound is short, and this is called an echo or a delay, if the time difference relatively increases further.

The reverberation time means a period of time during which a sound pressure of the test sound recorded at an output point of the test sound is reduced by 1/1,000,000 or a period of time taken for a decrease in sound pressure level by 60 dB. The reverberation time according to an embodiment of the disclosure may be a period of time during which a sound pressure of the recorded test sound is reduced by 1/1,000,000 of a sound pressure of the direct sound, or a period of time taken for a decrease in sound pressure level of the direct sound by 60 dB. However, this is merely an embodiment, and the reverberation time may be measured based on various references such as a period of time taken for a decrease in sound pressure level by 20 dB or 30 dB. Hereinafter, for convenience of description, a period of time taken for a decrease in sound pressure level by 60 dB (RT60) is assumed as the reverberation time.

The processor 130 according to an embodiment of the disclosure may obtain the reverberation time information for each frequency of the test sound and the size information of the space in which the electronic device 100 is positioned by analyzing the received sound data. The size information of the space may mean a volume.

For example, the processor 130 may obtain the size information of the space based on an energy intensity for each frequency until a volume of the test sound reaches a predetermined threshold value and an energy intensity for each frequency for a predetermined period of time from an output point of the test sound. The volume of the test sound may mean the sound pressure or the sound pressure level.

The processor 130 according to an embodiment of the disclosure may obtain a total energy intensity for each frequency as the energy intensity for each frequency until a volume of the test sound reaches a predetermined threshold value. For example, it may be assumed that the predetermined threshold value is 0 and the predetermined period of time is 50 milliseconds (msec). The predetermined threshold value which is 0 may mean that a direct sound and a reflected sound generated from the output test sound are all dissipated. In such a case, the processor 130 may obtain a total energy intensity of the direct sound and the reflected sound generated from the test sound and an energy intensity for 50 msec from the output point of the test sound. The processor 130 may obtain the size information of the space based on the following Mathematical Formula 1.

$$D = \frac{E_{50}}{E_{\infty}} \quad \text{[Mathematical Formula 1]}$$

Herein, E50 represents an energy intensity of the test sound in the sound data recorded for 50 msec from the output point and E∞ represents a total energy intensity of the test sound recorded in the sound data.

As the size of the space increases, the reflected sound and the reverberation may increase. Accordingly, the value of E∞ may increase and the size information D of the space may be reduced. The processor 130 may obtain information regarding a volume of the space in which the electronic device 100 is positioned, based on the size information D of the space.

However, this is merely an embodiment, and the processor 130 may also obtain the size information of the space based on a ratio of the energy intensity for each frequency for the predetermined period of time from the output point of the test sound, to an energy intensity for each frequency after the predetermined period of time. For example, the predetermined period of time may be assumed as 50 msec. In such a case, the processor 130 may obtain the size information of the space based on a ratio of sound energy recorded in the sound data for 50 msec from the output point of the test sound to sound energy recorded after 50 msec. The processor 130 may obtain the size information of the space based on the following Mathematical Formula 2.

$$C_{50} = 101\ g\left(\frac{E_{50}}{E_{\infty} - E_{50}}\right)[\text{dB}] \quad \text{[Mathematical Formula 2]}$$

Herein, E50 represents an energy intensity of the test sound recorded in the sound data for 50 msec from the output point and E∞ represents a total energy intensity of the test sound recorded in the sound data.

The size information of the space may be obtained as a value of D according to the Mathematical Formula 1 and a value of C50 according to the Mathematical Formula 2. The value of D and the value of C50 satisfies the following relationship according to the following Mathematical Formula 3.

$$C_{50} = 101\ g\left(\frac{D_{50}}{1 - D_{50}}\right)[\text{dB}] \quad \text{[Mathematical Formula 3]}$$

The processor 130 according to an embodiment of the disclosure may obtain the reverberation time information for each frequency of the test sound and the size information of the space by analyzing the sound data. The processor 130 may obtain a sound absorption coefficient of an object arranged in the space based on the reverberation time information for each frequency and the size information of the space obtained.

For example, the reflected sound of the output test sound excluding the direct sound means a sound that is partially absorbed by an object such as a wall, a carpet, or the like arranged in the space and partially not absorbed but reflected by the object and has reached the terminal device 200. The sound absorption coefficient means a ratio of a reflection energy to an incidence energy when the reflected sound is reflected by the object.

The sound absorption coefficient may vary depending on the object and frequency. For example, the reflected sounds having the same frequency may have different sound absorption coefficients according to the objects by which the sounds are reflected. In another example, the reflected sounds reflected by the same object may have different sound absorption coefficients according to the frequencies of the reflected sounds. A sound with a high frequency has a comparatively higher sound absorption coefficient than a sound with a low frequency. This will be described in detail with reference to FIG. 7.

The processor 130 according to an embodiment of the disclosure may obtain a sound absorption coefficient of an object based on the following Mathematical Formula 4.

$$T = 0.163\frac{V}{\sum S_i \alpha_i} = 0.163\frac{V}{A} \quad \text{[Mathematical Formula 4]}$$

Herein, T represents the reverberation time, V represents the volume of the space, and A represents an average sound absorption coefficient of the space. The processor 130 according to an embodiment of the disclosure may identify T based on the reverberation time information for each frequency and identify V based on the size information D of the space to identify a sound absorption coefficient A of an object arranged in the space.

The processor 130 according to an embodiment of the disclosure may identify the information of the object based on the sound absorption coefficient. The electronic device 100 may store information regarding the sound absorption coefficient of the object for each frequency in advance. The processor 130 may identify an object having a sound absorption coefficient similar to the obtained sound absorption coefficient based on the stored information.

The processor 130 according to an embodiment of the disclosure may output a first test sound and a second test sound respectively via first and second speakers arranged to be spaced apart from each other. For example, the first test sound may be output via the first speaker and the second test sound may be output via the second speaker after a predetermined period of time. The first test sound and the second test sound may be test sounds having a plurality of frequencies in the same frequency range. However, there is no limitation thereto, and the first test sound and the second test sound may be output at the same time.

When first and second sound data respectively corresponding to the first and second test sounds are received from the terminal device 200, the processor 130 may obtain the reverberation time information for each frequency of the first and second test sounds and the size information of the space in which the electronic device 100 is positioned based on the first and second sound data. For example, if the first speaker and the second speaker are right and left speakers, respectively, the processor 130 may also obtain the reverberation time information and the size information of the space for each of the left and right speakers.

Figure 3:
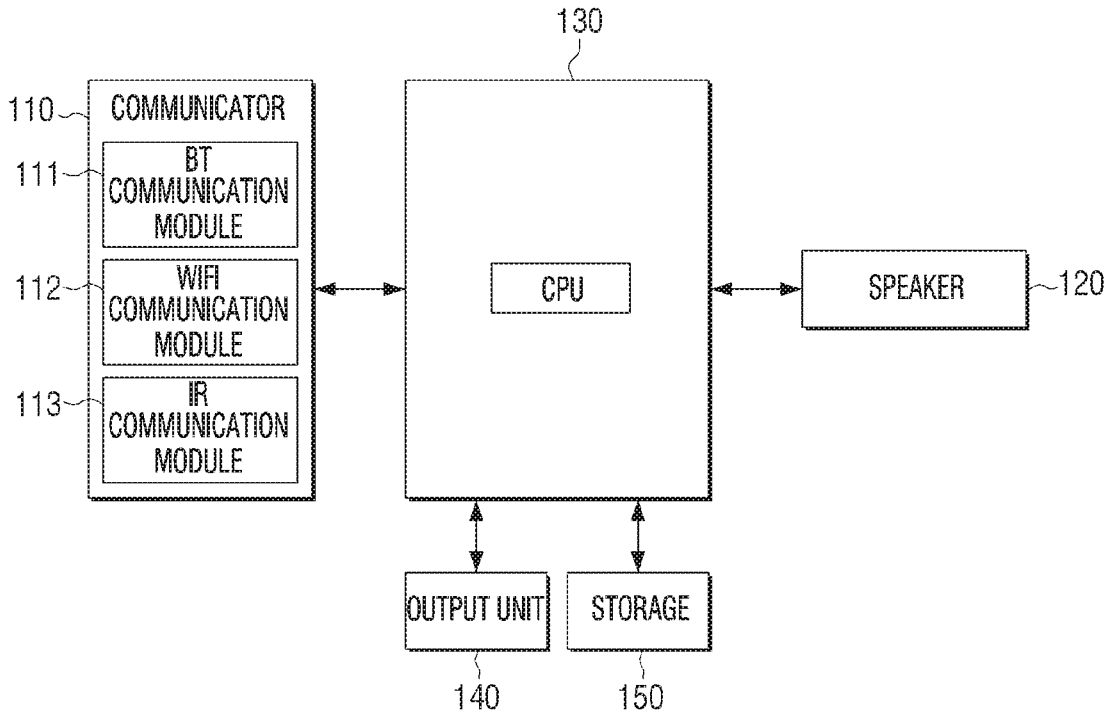
FIG. 3 is a block diagram illustrating a specific configuration of the electronic device according to an embodiment.

FIG. 3 is a block diagram illustrating a specific configuration of the electronic device according to an embodiment of the disclosure.

Referring to FIG. 3, the electronic device 100 may further include the communicator 110, the speaker 120, the processor 130, an output unit 140, and a storage 150. The specific description of components shown in FIG. 3 which are overlapped with the components shown in FIG. 2 will be omitted.

The communicator 110 according to an embodiment of the disclosure may communicate with the terminal device 200 through various communication systems using Radio Frequency (RF) and Infrared (IR) such as Local Area Network (LAN), cable, wireless LAN, cellular, Device to Device (D2D), Bluetooth, Bluetooth Low Energy (BLE), 3G, LTE, Wi-Fi, ad-hoc Wi-Fi Direct and LTE Direct, Zigbee, and Near Field Communication (NFC). For this, the communicator 110 may include an RF communication module such as a Zigbee communication module, a Bluetooth communication module 111, a BLE communication module, and a Wi-Fi communication module 112, and an IR communication module 113.

The processor 130 may include a CPU, a ROM (or a non-volatile memory) storing a control program for controlling the electronic device 100, and a RAM (or volatile memory) storing data input from the outside of the electronic device 100 or used as a storage area corresponding to various operations executed by the electronic device 100.

The CPU may execute the booting by using the 0/S stored in the memory 150 by accessing the memory 150. The CPU may execute various operations by using various programs, contents, data, and the like stored in the storage 150.

The output unit 140 may be implemented as at least one of a speaker unit and a display which are able to output audio and video contents. For example, the output unit 140 may be implemented as at least one speaker unit and may output an audio content. The output unit 140 may include a plurality of speakers for multi-channel reproduction. For example, the output unit 140 may include a plurality of speakers for each channel outputting mixed sounds. In some cases, a speaker for at least one channel may be implemented as a speaker array including a plurality of speaker units for reproducing sounds in frequency ranges different from each other.

In particular, if a sound absorption coefficient corresponding to at least one frequency among sound absorption coefficients of the object positioned in the space is equal to or higher than a predetermined value, the processor 130 may compensate the audio signal in the audio content and output the audio signal via the output unit 140. For example, if the sound absorption coefficient at 2,000 Hz is equal to or higher than 0.5, the processor 130 may amplify an audio signal corresponding to 2,000 Hz in the audio content and output the audio signal via the output unit 140. In another example, if the sound absorption coefficient at 200 Hz is equal to or lower than 0.5, the processor 130 may output an audio signal corresponding to 200 Hz in the audio content as it is. The value of 0.5 is merely an embodiment, and the predetermined value may be variously set according to setting of a user, setting in the content, or the purpose of the manufacturer.

According to an embodiment, the output unit 140 may be implemented as a display for outputting a video content. The display may be implemented as various types of displays such as a liquid crystal display (LCD), organic light emitting display (OLED), Liquid crystal on silicon (LCoS), or digital light processing (DLP). However, there is no limitation thereto and the display may be implemented as various types of display capable of displaying a screen. The output unit 140 may display a UI for guiding a position of the terminal device 200. For example, the electronic device 100 may display a UI for guiding a suitable position of the terminal device 200 to record the test sound output by the electronic device 100.

The storage 150 may store various data, programs, or applications for operating/controlling the electronic device 100. Particularly, the storage 150 may store the test sound according to an embodiment of the disclosure.

The storage 150 may be implemented as an internal memory such as a ROM, a RAM, and the like included in the processor 130 or may be implemented as a memory separated from the processor 130. In such a case, the storage 150 may be implemented in a form of a memory embedded in the electronic device 100 or may be implemented in a form of a memory detachable from the electronic device 100 according to data storage purpose. For example, data for operating the electronic device 100 may be stored in a memory embedded in the electronic device 100, and data for an extended function of the electronic device 100 may be stored in a memory detachable from the electronic device 100. The memory embedded in the electronic device 100 may be implemented in a form of a non-volatile memory, a volatile memory, a hard disk drive (HDD), or a solid state drive (SSD), and the memory detachable from the electronic device 100 may be implemented in a form of a memory card (e.g., a micro SD card, a USB memory, or the like), or an external memory connectable to a USB port (e.g., USB memory).

The storage 150 according to an embodiment of the disclosure may store the information of the sound absorption coefficient for each frequency of each of the plurality of objects, and the size information of the space according to a ratio of the energy intensity for each frequency for a predetermined period of time from the output point of the test sound, to an energy intensity for each frequency until a volume of the test sound reaches a predetermined threshold value. For example, information regarding the size of the space corresponding to the ratio obtained based on any one of the Mathematical Formulae 1 to 3 may be stored in the storage 150.

In another example, the storage 150 may store the size information of the space according to the reverberation time for each frequency and the ratio. The ratio herein may be the value of D or C50 obtained based on the Mathematical Formula 1 or 2, and the information stored in the storage 150 may be information indicating a relationship between the reverberation time for each frequency and the ratio, and the size of the space. This will be described in detail with reference to FIG. 8.

Figure 4:
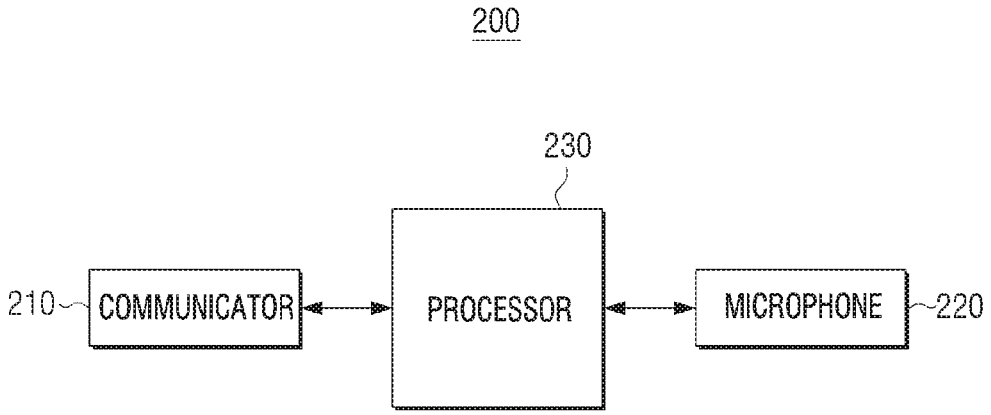
FIG. 4 is a block diagram illustrating a configuration of a terminal device according to an embodiment.

FIG. 4 is a block diagram illustrating a configuration of the terminal device according to an embodiment of the disclosure.

Referring to FIG. 4, the terminal device 200 includes a communicator 210, a microphone 220, and a processor 230.

The terminal device 200 may be implemented as various types of devices capable of outputting a signal for controlling the electronic device 100. For example, the terminal device 200 may be implemented as a remote control device outputting a control signal with respect to the electronic device 100.

The communicator 210 is a component for outputting a control signal and transmitting and receiving data to and from the electronic device 100. The communicator 210 according to an embodiment of the disclosure may execute communication with the electronic device 100 through various communication systems using Radio Frequency (RF) and Infrared (IR) such as Local Area Network (LAN), cable, wireless LAN, cellular, Device to Device (D2D), Bluetooth, Bluetooth Low Energy (BLE), 3G, LTE, Wi-Fi, ad-hoc Wi-Fi Direct and LTE Direct, Zigbee, and Near Field Communication (NFC). For this, the communicator 210 may include an RF communication module such as a Zigbee communication module, a Bluetooth communication module, a BLE communication module, and a Wi-Fi communication module, and an IR communication module.

Particularly, the communicator 210 may transmit a predetermined signal to the electronic device 100. The predetermined signal may be a signal controlling the electronic device 100 so that the electronic device 100 outputs the test sound.

The microphone 220 may record a signal or a sound. In particular, the microphone 220 may record the test sound output by the electronic device 100 and transmit the test sound to the processor 230. As will be described later, the processor 230 may generate sound data obtained by recording the test sound.

The processor 230 controls general operations of the electronic device 100. The processor 230 may include one or more of a signal digital signal processor (DSP), a central processing unit (CPU), a controller, an application processor (AP), or a communication processor (CP), and an ARM processor or may be defined as the corresponding term. In addition, the processor 230 may be implemented as System on Chip (SoC) or large scale integration (LSI) including the processing algorithm or may be implemented in form of a Field Programmable gate array (FPGA).

In particular, the processor 230 may transmit the predetermined signal to the electronic device 100 via the communicator 210 according to an input of a user. When the test sound output by the electronic device 100 is recorded by the microphone 220, the sound data may be generated.

The processor 230 according to an embodiment of the disclosure may transmit the sound data to the electronic device 100 via the communicator 210. In another example, the processor 230 may perform the same operation as those of the processor 130 of the electronic device 100. For example, the processor 230 of the terminal device 200 may obtain the reverberation time information for each frequency and the size information of the space by analyzing the sound data.

The processor 230 may obtain a sound absorption coefficient of an object arranged in the space based on the reverberation time information for each frequency and the size information of the space obtained. Accordingly, the sound absorption coefficient of the object arranged in the space in which the electronic device 100 is positioned may be obtained by the processor 130 of the electronic device 100 or the processor 230 of the terminal device 200.

Figure 5:
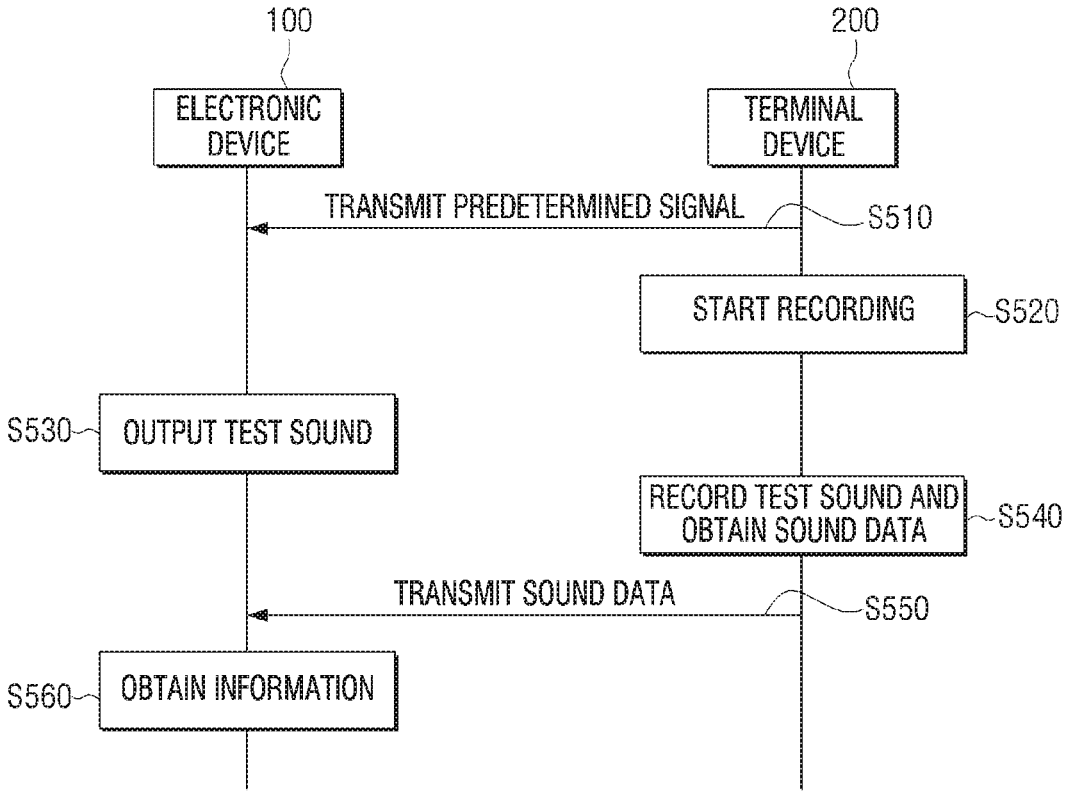
FIG. 5 is a sequence diagram for explaining operations between the electronic device and the terminal device according to an embodiment.

FIG. 5 is a sequence diagram for explaining operations between the electronic device and the terminal device according to an embodiment of the disclosure.

Referring to FIG. 5, the external terminal device 200 may transmit a predetermined signal to the electronic device 100 (S510) and start recording (S5220).

When the predetermined signal is received, the electronic device 100 may output the test sound (S530).

Then, the electronic device 200 may record the test sound and obtain sound data (S540). The terminal device 200 may transmit the sound data to the electronic device 100 (S550).

Next, the electronic device 100 may obtain reverberation time information for each frequency of the test sound and size information of a space in which the electronic device is positioned, based on the received sound data (S560).

Hereinafter, a method for obtaining the reverberation time information for each frequency and the size information of the space will be described with a graph.

Figure 6:
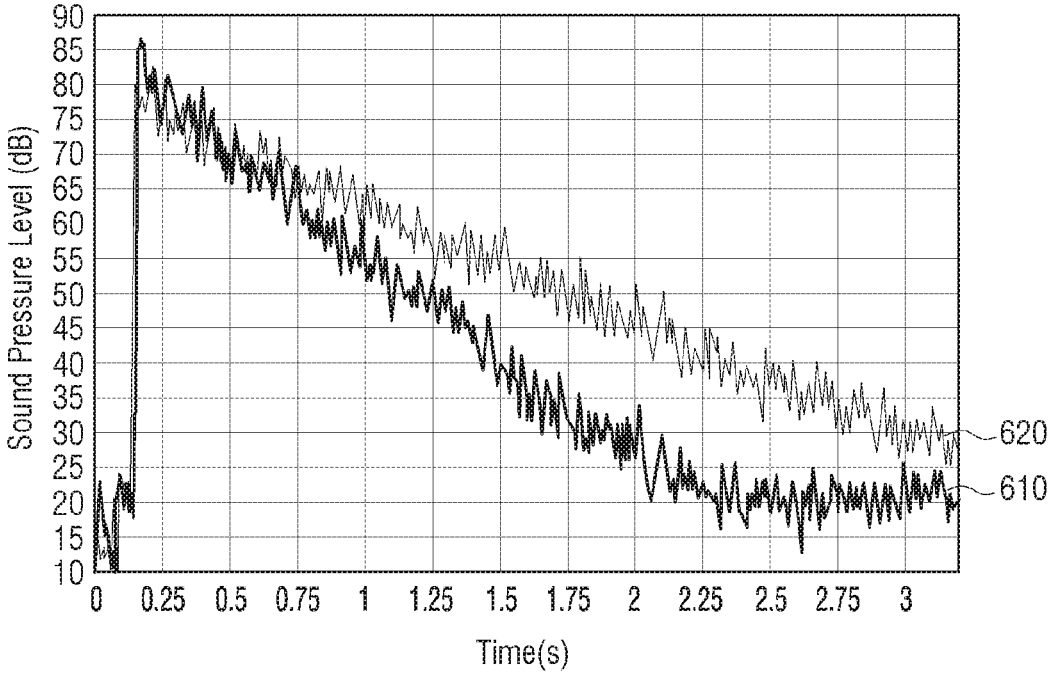
FIG. 6 is a graph for explaining a sound pressure level of a test sound according to an embodiment.

FIG. 6 is a graph for explaining a sound pressure level of the test sound according to an embodiment of the disclosure.

Referring to FIG. 6, first and second frequencies 610 and 620 may be audio frequencies of the test sound. Sound pressure levels SPL (dB) of the test sound recorded at the output point of the first and second frequencies 610 and 620 reach maximum levels and then gradually decrease. For example, the sound pressure level at the first frequency 610 reaches a maximum level at approximately 0.2 sec and then gradually decreases. The period of time taken for a decrease by 60 dB may mean the reverberation time. For example, referring to FIG. 6, it is found that the period of time taken for a decrease in the sound pressure level at the first frequency 610 by 60 dB from 82 dB, which is the maximum level, to 22 dB is approximately 3 sec. The reverberation time at the first frequency 610 may be 3 sec.

The sound pressure level at the second frequency 620 reaches a maximum level at approximately 0.2 sec and then gradually decreases. Referring to FIG. 6, it is found that the period of time taken for a decrease in the sound pressure level at the second frequency 620 from 86 dB to 26 dB is approximately 2 sec. The reverberation time at the second frequency 620 may be 2 sec.

The electronic device 100 may obtain the size information of the space in which the electronic device 100 is positioned based on the sound data. For example, the electronic device 100 may obtain the size information of the space based on a ratio of sound energy of the sound data for first 50 msec to sound energy after 50 msec. In such a case, the electronic device 100 may obtain the ratio based on the Mathematical Formula 2.

In another example, the electronic device 100 may obtain the size information of the space based on a ratio of sound energy of the sound data for first 50 msec to total sound energy of the sound data. In such a case, the electronic device 100 may obtain the ratio based on the Mathematic Formula 1.

In the Mathematic Formula 1, E50 may be obtained based on the following Mathematic Formula 5.

$$E_{50}=\int_0^{0.05} p^2 dt \qquad \text{[Mathematical Formula 5]}$$

$E_\infty$ may be obtained based on the following Mathematic Formula 6.

$$E_\infty=\int_0^{\infty} p^2 dt \qquad \text{[Mathematical Formula 6]}$$

Herein, $P^2$ represents energy of sound (sound energy).

The electronic device 100 according to an embodiment of the disclosure may obtain information regarding a size of a space in which the electronic device 100 is positioned by using the above Mathematic Formulae based on the sound data. For example, D50 represents energy of a direct sound of the output test sound, that is, a sound reached the terminal device 200 without reflection. E∞ represents energy of the direct sound and the reflected sound according to the output test sound. As the size of the space in which the electronic device 100 is arranged increases, the energy of the reflected sound and the reverberation sound may proportionally increase, compared to the direct sound. E∞ have a relatively larger value in a wider space, rather than a small space. The electronic device 100 may obtain information regarding the size of the space in which the electronic device 100 is arranged, based on the ratio of E50 and E∞.

Figure 7:
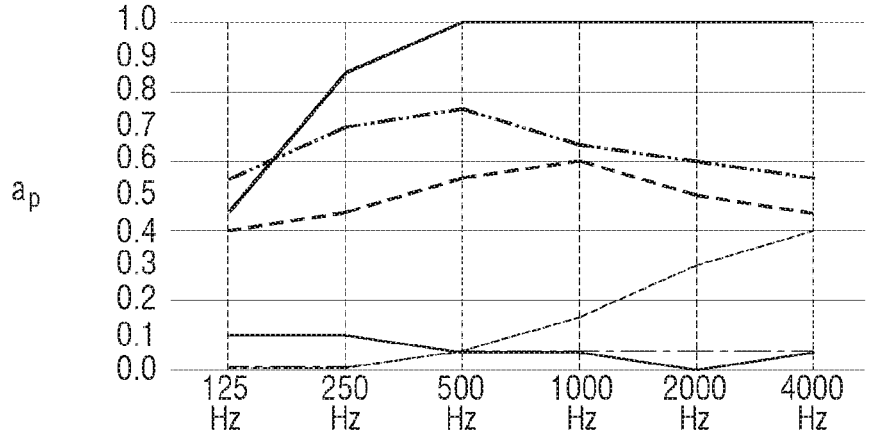
FIG. 7 is a view for explaining a sound absorption coefficient for each object according to an embodiment.

FIG. 7 is a view for explaining a sound absorption coefficient for each object according to an embodiment of the disclosure.

Referring to FIG. 7, the electronic device 100 may store information regarding the sound absorption coefficient of the object for each frequency in advance. For example, a carpet has a sound absorption coefficient of 0.01 at a frequency of 125 Hz and a sound absorption coefficient of 0.3 at a frequency of 2,000 Hz.

The electronic device 100 according to an embodiment of the disclosure may obtain the sound absorption coefficient of the object based on the reverberation time for each frequency and the size information of the space obtained through the graph of FIG. 6. The electronic device 100 may identify an average sound absorption coefficient A of a space according to the reverberation time T for each frequency and a volume V of the space in the following Mathematical Formula 4.

$$T = 0.163\frac{V}{\sum S_i\alpha_i} = 0.163\frac{V}{A} \qquad \text{[Mathematical Formula 4]}$$

Herein, T represents the reverberation time, V represents the volume of the space, and A represents the average sound absorption coefficient of the space.

The electronic device 100 may identify an object corresponding to the average sound absorption coefficient A of the space based on the information stored in advance. For example, if a sound absorption coefficient of 0.01 at a frequency of 125 Hz is identified and a sound absorption coefficient of 0.3 at a frequency of 2,000 Hz is identified, the electronic device 100 may identify that a carpet is arranged in the space.

The sound absorption coefficient of the object for each frequency shown in FIG. 7 is an example and the electronic device 100 may store sound absorption coefficients of various objects in advance. For example, the electronic device 100 may store sound absorption coefficients of furniture such as a sofa, a wardrobe, and a bed, curtain, and the like which are normally in a house. In another example, the electronic device 100 may receive information of a sound absorption coefficient of an object by executing communication with a server (not shown) and may also update information of a sound absorption coefficient stored in advance by executing communication with a server (not shown).

Figure 8:
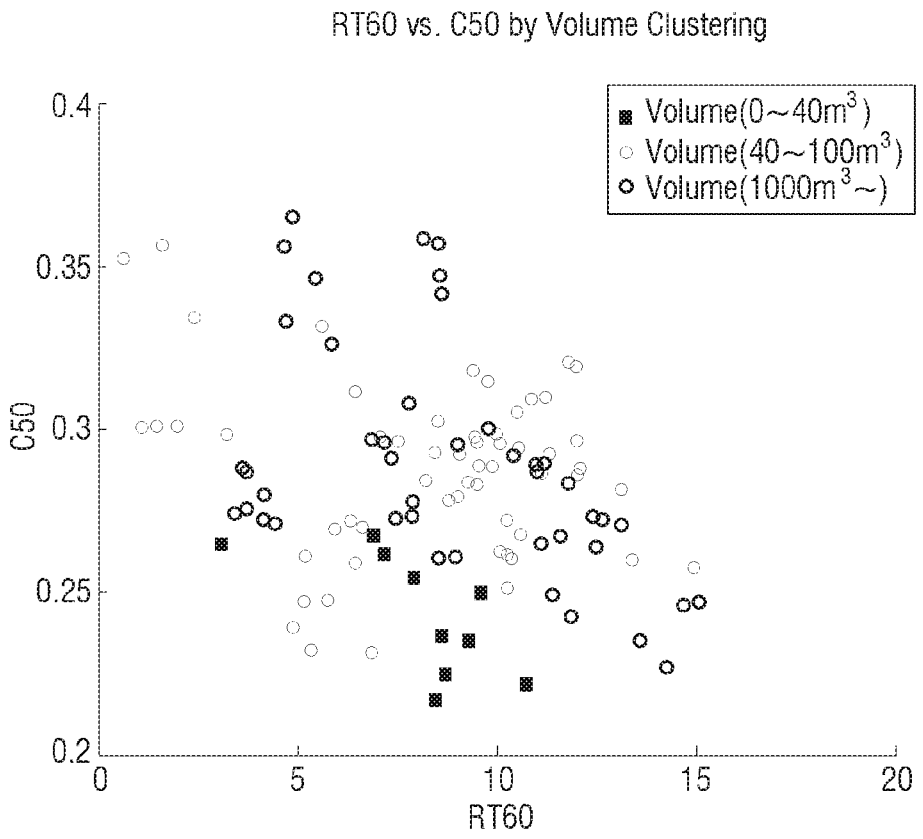
FIG. 8 is a view for explaining size information of a space according to an embodiment.

FIG. 8 is a view for explaining size information of a space according to an embodiment of the disclosure.

Referring to FIG. 8, the electronic device 100 may store the size information of the space according to the reverberation time for each frequency and the ratio. For example, the reverberation time for each frequency may be a value of RT60 and the ratio may be a value of D or C50 obtained based on the Mathematical Formula 1 or 2.

The information stored in the electronic device 100 may be information indicating a relationship between the reverberation time for each frequency and the ratio, and the size of the space. For example, the electronic device 100 may identify the size of the space corresponding to the values of RT60 and C50 based on the information. For example, if RT60 is 10 and C50 is 0.25, the electronic device 100 may determine that the volume of the space is in a range of 40 to 100 $m^3$ according to the graph shown in FIG. 8.

The graph shown in FIG. 8 is an example, and a graph showing information regarding the size of the space according to the reverberation time and the ratio may be received by executing communication with a server (not shown) and information stored in advance may be updated by executing communication with a server (not shown). In addition, in the graph shown in FIG. 8, the X axis indicates RT60 and the Y axis indicates C50, but there is no limitation thereto, and the X axis may indicate RT30 or the like and the Y axis may indicate C80 or the like.

Figure 9:
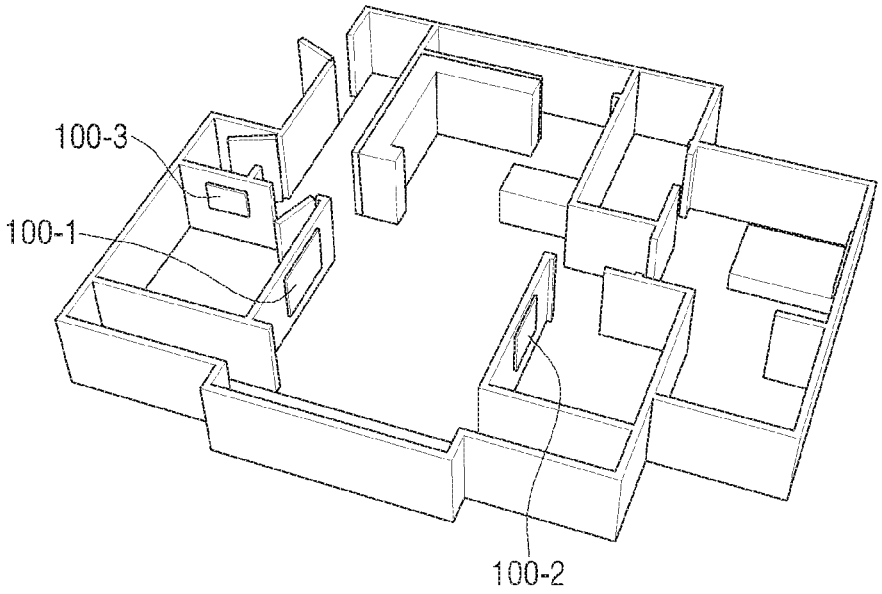
FIG. 9 is a view for explaining operations between the electronic device and other electronic devices according to an embodiment.

FIG. 9 is a view for explaining operations between the electronic device and other electronic devices according to an embodiment of the disclosure.

As shown in FIG. 9, a plurality of electronic devices 100-1 to 100-3 may be located in a house.

For example, it may be assumed that a first electronic device 100-1 is positioned in a first space including a first object and a second electronic device 100-2 is positioned in a second space including a second object. When at least one of size information of the second space in which the other electronic device is positioned and information of the second object included in the second space is received from the other electronic device (e.g., second electronic device 100-2), the electronic device 100 may identify the first electronic device 100-1 as a communal electronic device or a personal electronic device based on the received information and the information of the size of the first space and the first object.

For example, the first electronic device 100-1 may be positioned in a living room where sofa and the like are arranged, and the second electronic device 100-2 may be positioned in a private space such as a bedroom. The first electronic device 100-1 may identify that the sofa is located in the space where the first electronic device 100-1 is positioned and the size information of the space, based on the reverberation time for each frequency and the size information of the space.

According to an embodiment, when at least one of information of a size of a bedroom where the second electronic device 100-2 is positioned and information indicating whether or not a bed is arranged is transmitted to the first electronic device 100-1 from the second electronic device 100-2, the first electronic device 100-1 may identify the first electronic device 100-1 as a communal electronic device or a personal electronic device based on the received information, the information of the size of the living room, and the information indicating whether or not the sofa is arranged in the living room. The size of the living room is comparatively larger than that of the bedroom when comparing the size of the living room with the size of the bedroom, the first electronic device 100-1 may determine that the first electronic device 100-1 is positioned in the living room. In addition, the first electronic device 100-1 may identify itself as a communal electronic device.

In another example, the reverse case may also be satisfied. When at least one of information of a size of a living room where the first electronic device 100-1 is positioned and information indicating whether or not sofa is arranged is transmitted to the second electronic device 100-2 from the first electronic device 100-1, the second electronic device 100-2 may identify the second electronic device 100-2 as a personal electronic device based on the received information, the information of the size of the bedroom, and the information indicating whether or not the bed is arranged in the bedroom.

According to an embodiment of the disclosure, if the electronic device 100 is identified as a communal electronic device, an access to at least one of a setting menu of the electronic device 100, a content payment menu, and a content view history menu by a user may be limited. For example, the communal electronic device means an electronic device used by a plurality of users, and accordingly, an access to the device setting menu and the content payment menu may be limited. Since the electronic device 100 positioned in the living room may be accessed by kids among family members, it is necessary to limit an access to the content payment menu so that the content payment or the like is not easily performed.

In another example, the reverse case may also be satisfied. For example, if the electronic device 100 is identified as a personal electronic device, an access to at least one of a setting menu of the electronic device 100, a content payment menu, and a content view history menu by a user may be limited. An input of a personal PIN number may be requested, and the access to the setting menu, the content payment menu, and the content view history menu may be permitted only when the PIN number is input.

Figure 10:
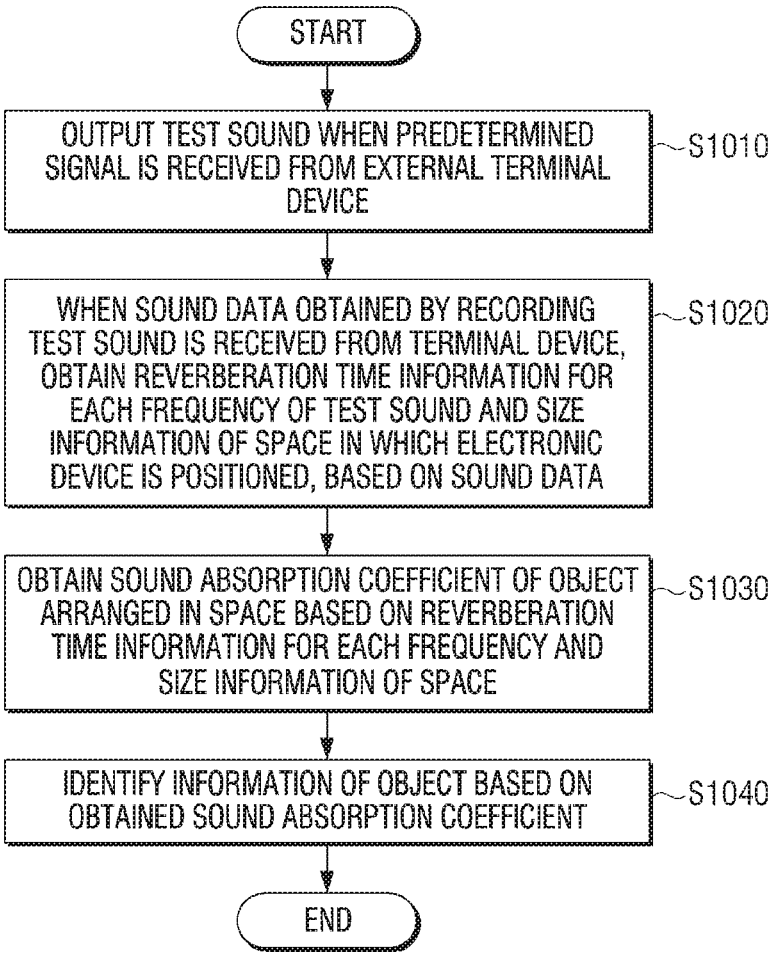
FIG. 10 is a flowchart for explaining a method for controlling the electronic device according to an embodiment.

FIG. 10 is a flowchart for explaining a method for controlling the electronic device according to an embodiment of the disclosure.

According to the method for controlling the electronic device shown in FIG. 10, when a predetermined signal is received from an external terminal device, a test sound is output (S1010).

Then, when sound data obtained by recording the test sound is received from the terminal device, reverberation time information for each frequency of the test sound and size information of a space in which the electronic device is positioned are obtained based on the sound data (S1020). Herein, the size of the space is obtained based on an energy intensity for each frequency until a volume of the test sound reaches a predetermined threshold value and an energy intensity for each frequency for a predetermined period of time from an output point of the test sound.

Then, a sound absorption coefficient of an object arranged in the space is obtained based on the reverberation time information for each frequency and the size information of the space (S1030).

Next, information of the object is identified based on the obtained sound absorption coefficient (S1040).

The test sound herein may have a plurality of different frequencies in a range of the audio frequency.

The control method according to an embodiment of the disclosure may include outputting an audio content, and when a sound absorption coefficient corresponding to at least one frequency among sound absorption coefficients of the object positioned in the space is equal to or higher than a predetermined value, an audio signal corresponding to the frequency may be compensated in the audio content and output.

In addition, in Step S1020 of obtaining the size information of the space, the size information of the space may be obtained based on a ratio of the energy intensity for each frequency for a predetermined period of time from the output point of the test sound, to an energy intensity for each frequency until a volume of the test sound reaches a predetermined threshold value.

The electronic device may store the information of the sound absorption coefficient for each object and space size information for each ratio, and the size information of the space may be obtained based on the space size information for each ratio in Step S1020 of obtaining the size information of the space, and a sound absorption coefficient of an object arranged in the space may be obtained based on the information of the sound absorption coefficient for each object in Step S1030 of obtaining the sound absorption coefficient.

In another example, the electronic device may store the size information of the space according to the reverberation time for each frequency and the ratio, and the size information of the space may be obtained based on the information in Step S1020 of obtaining the size information of the space.

In addition, the reverberation time may be a period of time taken for a decrease in sound pressure level of the test sound recorded at an output point of the test sound by 60 dB.

In addition, the electronic device may be positioned in a first space including a first object, and the control method according to an embodiment of the disclosure may include receiving at least one of size information of a second space in which the other electronic device is positioned and information of a second object included in the second space from the other electronic device, and identifying the electronic device as a communal electronic device or a personal electronic device based on the received information and information of a size of the first space and the first object.

The control method may include, based on the electronic device being identified as a communal electronic device, limiting an access to at least one of a setting menu of the electronic device, a content determination menu, a content view history menu.

The embodiments described above may be implemented in a recording medium readable by a computer or a similar device using software, hardware, or a combination thereof. In some cases, the embodiments described in this specification may be implemented as a processor itself. According to the implementation in terms of software, the embodiments such as procedures and functions described in this specification may be implemented as software modules. Each of the software modules may execute one or more functions and operations described in this specification.

Computer instructions for executing processing operations according to the embodiments of the disclosure descried above may be stored in a non-transitory computer-readable medium. When the computer instructions stored in such a non-transitory computer-readable medium are executed by the processor, the computer instructions may enable a specific machine to execute the processing operations according to the embodiments described above.

The non-transitory computer-readable medium is not a medium storing data for a short period of time such as a register, a cache, or a memory, but means a medium that semi-permanently stores data and is readable by a machine. Specific examples of the non-transitory computer-readable medium may include a CD, a DVD, a hard disk, a Blu-ray disc, a USB, a memory card, and a ROM.

Hereinabove, the preferred embodiments of the disclosure have been shown and described, but the disclosure is not limited to specific embodiments described above, various modifications may be made by those skilled in the art without departing from the gist of the disclosure claimed in the claims, and such modifications may not be individually understood from the technical sprit or the prospect of the disclosure.

What is claimed is:

1. An electronic device comprising:

a communicator;

a speaker; and a processor configured to, based on a predetermined signal being received from an external terminal device via the communicator, output a test sound via the speaker, based on sound data obtained by recording the test sound being received from the terminal device via the communicator, obtain reverberation time information for each frequency of the test sound and size information of a space in which the electronic device is positioned, based on the sound data, obtain a sound absorption coefficient of an object arranged in the space based on the reverberation time information for each frequency and the size information of the space, and identify information of the object based on the sound absorption coefficient, wherein a size of the space is obtained based on an energy intensity for each frequency until a volume of the test sound reaches a predetermined threshold value and an energy intensity for each frequency for a predetermined period of time from an output point of the test sound.

2. The device according to claim 1, wherein the test sound is a sound having a plurality of different frequencies in a range of audio frequency.

3. The device according to claim 2, further comprising:

an output unit, wherein the processor is configured to control the output unit to output an audio content, and based on a sound absorption coefficient corresponding to at least one frequency among sound absorption coefficients of an object positioned in the space being equal to or higher than a predetermined value, compensate an audio signal corresponding to the frequency in the audio content and output the audio signal.

4. The device according to claim 1, wherein the processor is configured to obtain size information of the space based on a ratio of the energy intensity for each frequency for a predetermined period of time from the output point of the test sound, to the energy intensity for each frequency until a volume of the test sound reaches a predetermined threshold value.

5. The device according to claim 4, further comprising:

a storage storing information of a sound absorption coefficient for each object and space size information for each ratio, wherein the processor is configured to obtain a sound absorption coefficient of an object arranged in the space and size information of the space based on the information stored in the storage.

6. The device according to claim 4, further comprising:

a storage storing size information of the space according to the reverberation time for each frequency and the ratio, wherein the processor is configured to obtain the size information of the space based on the information stored in the storage.

7. The device according to claim 1, wherein the reverberation time is a period of time taken for a decrease in sound pressure level of the test sound recorded at an output point of the test sound by 60 dB.

8. The device according to claim 1, wherein the electronic device is positioned in a first space including a first object, and wherein the processor is configured to, based on at least one of size information of a second space in which another electronic device is positioned and information of a second object included in the second space being received from the other electronic device, identify the electronic device as a communal electronic device or a personal electronic device based on the received information and information of a size of the first space and the first object.

9. The device according to claim 8, wherein the processor is configured to, based on the electronic device being identified as the communal electronic device, limit an access to at least one of a setting menu of the electronic device, a content payment menu, and a content view history menu.

10. The device according to claim 1, wherein the speaker includes first and second speakers arranged to be spaced apart from each other, and wherein the processor is configured to output a first test sound via the first speaker, and output a second test sound via the second speaker after a predetermined period of time, and based on first and second sound data pieces corresponding to the first and second test sounds, respectively, being received from the terminal device, obtain reverberation time information for each frequency of the first and second test sounds and size information of a space in which the electronic device is positioned, based on the first and second sound data.

11. A method for controlling an electronic device, the method comprising:

based on a predetermined signal being received from an external terminal device, outputting a test sound;

based on sound data obtained by recording the test sound being received from the terminal device, obtaining reverberation time information for each frequency of the test sound and size information of a space in which the electronic device is positioned, based on the sound data, obtaining a sound absorption coefficient of an object arranged in the space based on the reverberation time information for each frequency and the size information of the space, and identifying information of the object based on the obtained sound absorption coefficient, wherein a size of the space is obtained based on an energy intensity for each frequency until a volume of the test sound reaches a predetermined threshold value and an energy intensity for each frequency for a predetermined period of time from an output point of the test sound.

12. The method according to claim 11, wherein the test sound is a sound having a plurality of different frequencies in a range of audio frequency.

13. The method according to claim 12, further comprising:

outputting an audio content, wherein the outputting comprises, based on a sound absorption coefficient corresponding to at least one frequency among sound absorption coefficients of an object positioned in the space being equal to or higher than a predetermined value, compensating an audio signal corresponding to the frequency in the audio content and outputting the audio signal.

14. The method according to claim 11, wherein the obtaining size information of a space comprises obtaining size information of the space based on a ratio of the energy intensity for each frequency for a predetermined period of time from the output point of the test sound, to the energy intensity for each frequency until a volume of the test sound reaches a predetermined threshold value.

15. The method according to claim 14, wherein the electronic device stores information of a sound absorption coefficient for each object and space size information for each ratio, wherein the obtaining size information of a space comprises obtaining size information of the space based on the space size information for each ratio, and wherein the obtaining a sound absorption coefficient comprises obtaining a sound absorption coefficient of an object arranged in the space based on the information of a sound absorption coefficient for each object.

* * * * *